US006547927B1

(12) United States Patent
Takeuchi et al.

(10) Patent No.: US 6,547,927 B1
(45) Date of Patent: Apr. 15, 2003

(54) WATER-DECOMPOSABLE FIBROUS SHEET CONTAINING WATER-INSOLUBLE CARBOXYMETHYL CELLULOSE

(75) Inventors: Naohito Takeuchi, Kagawa (JP); Takayoshi Konishi, Kagawa (JP); Jyoji Shimizu, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 269 days.

(21) Appl. No.: 09/664,231

(22) Filed: Sep. 18, 2000

(30) Foreign Application Priority Data

Sep. 30, 1999 (JP) ..... 11-279949

(51) Int. Cl.[7] ..... D21F 11/00

(52) U.S. Cl. ..... 162/115; 162/141; 162/146; 162/149; 162/158; 162/177; 162/181.1; 162/181.2; 162/183; 428/152; 428/154

(58) Field of Search ..... 162/115, 141, 162/146, 149, 158, 177, 181.1, 181.2, 183; 428/152, 154, 198; 442/311

(56) References Cited

U.S. PATENT DOCUMENTS 5,840,633 A * 11/1998 Kurihara et al. ..... 428/152
5,958,555 A * 9/1999 Takeuchi et al. ..... 428/152

FOREIGN PATENT DOCUMENTS

| | | |
|---|---|---|
| EP | 0802282 A1 | 10/1997 |
| JP | 01168999 | 4/1989 |
| JP | 1-168999 | 7/1989 |
| JP | 03180596 | 6/1991 |
| JP | 6192991 | 12/1994 |
| JP | 9-132896 | 5/1997 |
| JP | 9-132897 | 5/1997 |
| JP | 10-310960 | 11/1998 |

* cited by examiner

*Primary Examiner*—Steven P. Griffin
*Assistant Examiner*—M. Halpern
(74) *Attorney, Agent, or Firm*—Darby & Darby

(57) ABSTRACT

There is disclosed a water-decomposable fibrous sheet including water-dispersible fibers and water-insoluble carboxymethyl cellulose. The water-insoluble carboxymethyl cellulose has a degree of substitution for etherification (DE) falling between 0.3 and 0.6. In the water-insoluble carboxymethyl cellulose, the hydrogen of the carboxyl group in at least 95% of the carboxymethyl groups is substituted with a metal.

8 Claims, No Drawings

WATER-DECOMPOSABLE FIBROUS SHEET CONTAINING WATER-INSOLUBLE CARBOXYMETHYL CELLULOSE

BACKGROUND OF THE INVENTION

1. Field of the Invention

The present invention relates to a water-decomposable fibrous sheet capable of being readily decomposed and dispersed in water flow. More precisely, it relates to a water-decomposable fibrous sheet of which the decomposability in water measured in wet, the strength at break measured in dry, and the strength at break measured in wet are all good, even though not containing a large amount of an organic solvent.

2. Description of the Related Art

To wipe the skin of human bodies including the private parts thereof, or to clean toilets and thereabouts, fibrous sheets are used as wiper sheets. The strength of the wiper sheets must be enough for wiper applications. In view of easy use and work effectiveness, moreover, many fibrous sheets are used while being previously wetted with a detergent chemical or the like. Therefore, the fibrous sheets must have high strength even in wet to such a degree that they are well fit for wiping with them containing a detergent chemical or the like.

On the other hand, the fibrous sheets of the type are preferably decomposable in water in order that they could be directly flushed in toilets after their use. This is because, if hardly water-decomposable sheets are flushed in toilets or the like, they will take a lot of time until they are decomposed and dispersed in septic tanks, or will clog the drain-pipes around toilets, etc.

Accordingly, the fibrous sheets to be used in wet with a detergent chemical or the like infiltrated thereinto must satisfy the two contradictory requirements, one being that they must have high strength even in wet with a detergent chemical or the like infiltrated thereinto to such a degree that they are well fit for wiper applications, and the other being that they must be decomposable in water after flushed in toilets.

Regarding fibrous sheets of the type, Japanese Unexamined Patent Publication (Kokai) No. Heisei 1-168999 discloses a water-dispersible cleaning article of easily water-dispersible paper prepared from a mixture of from 60 to 99% by weight of water-dispersible fibers for paper and from 1 to 40% by weight of water-insoluble carboxymethylated pulp, wherein the paper carries an active substance-containing organic compound applied thereto. However, the cleaning article shall contain a mixture of from 5 to 60% by weight of water and from 40 to 95% by weight of an active substance-containing organic compound (e.g., mono- or polyalcohols, oils, fats, etc.) infiltrated thereinto to an extent of from 0.5 to 5 times the self-weight of the article. As containing a large amount of a skin-irritating compound such as alcohol or the like, the article could not be used for wiping the private parts of babies and infants. In addition, as containing an organic solvent, the cleaning article will damage resin objects if applied thereto.

Japanese Unexamined Patent Publication (Kokai) Nos. Heisei 9-132896 and Heisei 9-132897 disclose water-decomposable sheets which contain water-insoluble or water-swellable carboxymethyl cellulose along with sodium carbonate added thereto. However, the decomposability in water of the water-decomposable sheets is not satisfactory.

Japanese Unexamined Patent Publication (Kokai) No. Heisei 10-310960 discloses a water-decomposable non-woven fabric that comprises regenerated cellulose fibers and wood pulp entangled together. This non-woven fabric contains from 3 to 17% by weight of carboxymethylated fibers in which the carboxyl group accounts for from 10 to 60% of all carboxymethyl groups. When heated, the non-woven fabric loses its ability to decompose in water, since the carboxymethyl groups constituting the carboxymethylated fibers therein bond to each other through hydrogen bonding under heat. In that situation, desired is a fibrous sheet of better decomposability in water.

SUMMARY OF THE INVENTION

An object of the present invention is to provide a fibrous sheet capable of readily decomposing in water and having good dry strength and wet-strength enough for use.

Another object of-the invention is to provide a fibrous sheet suitable to any type of wiper applications.

According to the invention, there is provided a water-decomposable fibrous sheet that comprises water-dispersible fibers and water-insoluble carboxymethyl cellulose, wherein;

the water-insoluble carboxymethyl cellulose has a degree of substitution for etherification (DE) falling between 0.3 and 0.6, and, in the water-insoluble carboxymethyl cellulose, the hydrogen of the carboxyl group in at least 95% of the carboxymethyl groups is substituted with a metal.

Though having high strength at break both in dry and in wet enough for use, the water-decomposable fibrous sheet of the invention well decomposes in water. Accordingly, the fibrous sheet does not require a large amount of an organic solvent that will irritate the skin, and therefore has many applications, for example, for wiping the private parts of human bodies and for cleaning resin objects.

In the fibrous sheet of the invention, the metal is preferably at least one selected from the group consisting of calcium, sodium, magnesium, zinc, manganese, lithium, barium and aluminium.

Also preferably, the fibrous sheet has a basis weight falling between 30 and 80 g/m$^2$. In this case, still preferably, the water-insoluble carboxymethyl cellulose content of the fibrous sheet falls between 0.5 and 10% by weight. Still preferably, the fibrous sheet has a thickness of at least 0.1 mm.

Also preferably, the fibrous sheet is a water-decomposable non-woven fabric having been subjected to water-jetting treatment, or water-decomposable paper having been prepared in a paper-making process.

Also preferably, the water-dispersible fibers constituting the fibrous sheet are fibers of at least one type selected from the group consisting of pulp, regenerated cellulose, Manila hemp, and linter pulp.

Also preferably, the fibrous sheet has a degree of decomposition in water of at most 100 seconds measured in wet according to JIS P4501, a strength at break in dry of at least 1000 g/25 mm, and a strength at break in wet of at least 100 g/25 mm.

DESCRIPTION OF THE PREFERRED EMBODIMENTS

The water-decomposable fibrous sheet of the invention is described in detail hereinbelow.

For the water-decomposable fibrous sheet of the invention, used are water-dispersible fibers, i.e., fibers well dispersible in water. The dispersibility in water referred to herein has the same meaning as the decomposability in water, and is meant to indicate that the fibers constituting the sheet are decomposed and dispersed well in water when kept in contact with a large amount of water.

The water-dispersible fibers constituting the sheet of the invention may be any of natural fibers and/or chemical fibers. The natural fibers include those from wood pulp such as soft wood pulp, hard wood pulp, etc.; and also those from Manila hemp, linter pulp, etc. The chemical fibers include regenerated fibers of rayon and fibrillated rayon; synthetic fibers of polypropylene, polyvinyl alcohol, polyester, polyacrylonitrile, etc. Of those, preferred are pulp and rayon, as being well dispersible in water.

The fiber length of the water-dispersible fibers is preferably at most 20 mm for the decomposability in water of the fibrous sheet comprising the fibers. More preferably, it falls between 2 mm and 10 mm. In case where rayon is used for the water-dispersible fibers, its fineness preferably falls between 1.0 and 3.0 deniers.

The fibrous sheet of the invention contains water-insoluble carboxymethyl cellulose (CMC) serving as a binder. In this, the water-insoluble carboxymethyl cellulose has a degree of substitution for etherification falling between 0.3 and 0.6. Preferably, the water-insoluble carboxymethyl cellulose has pH of at least 5.0.

The water-insoluble carboxymethyl cellulose to be in the fibrous sheet is of a type of complete substitution in which the hydrogen of the carboxyl group in at least 95%, preferably at least 99.0%, more preferably at least 99.9% of the carboxymethyl groups is substituted with a metal. Concretely, in the water-insoluble carboxymethyl cellulose to be represented by the following formula (1), M in at least 95% of the carboxyl groups (surrounded by the dotted line) is a metal while M in smaller than 5% thereof is a hydrogen atom.

(1)

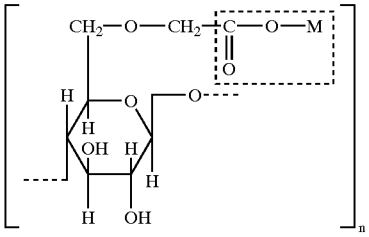

Preferably, the metal is at least one selected from the group consisting of calcium, sodium, magnesium, zinc, manganese, lithium, barium and aluminium. Of those, preferred are/is calcium and/or sodium.

From the above-mentioned water-dispersible fibers and water-insoluble carboxymethyl cellulose, the fibrous sheet of the invention is produced. In the fibrous sheet of the invention thus produced, the water-insoluble carboxymethyl cellulose is of a type of complete substitution. In this, therefore, the remaining carboxyl group in the water-insoluble carboxymethyl cellulose (in which M is a hydrogen atom) is prevented from bonding to each other through hydrogen bonding (or ester bonding) to lower the decomposability in water of the fibrous sheet. Specifically, in the fibrous sheet in dry, the water-insoluble carboxymethyl cellulose functions as a binder. Therefore, the dry fibrous sheet has higher strength than the others not containing a binder. On the other hand, when the fibrous sheet is wetted with a small amount of water, the water-insoluble binder does not dissolve in water, and therefore the fibrous sheet can still maintain its strength even in wet.

When the fibrous sheet of the invention is brought into contact with a large amount of water, the water-insoluble CMC therein swells and loses its capability to sustain the sheet. As a result, the fibrous sheet is degraded even by slight force (water flow) applied thereto. The decomposability in water of the fibrous sheet referred to herein has the same meaning as the dispersibility thereof in water, and is meant to indicate that the fibers constituting the sheet are well decomposed and dispersed in water when kept in contact with a large amount of water, thereby resulting in that the sheet is pulverized into fine pieces.

In order that the fibrous sheet may have suitable dry strength and wet strength, the amount of water-insoluble carboxymethyl cellulose to be in the sheet preferably falls between 0.5 and 10% by weight, more preferably between 0.5 and 7% by weight.

Also preferably, the basis weight (this may be referred to as "Metsuke") of the fibrous sheet falls between 30 and 80 $g/m^2$. If its basis weight is smaller than the lowermost limit of the defined range, the sheet could not have the necessary strength for wiper applications. If, however, its basis weight is larger than the uppermost limit of the defined range, the sheet will be not flexible. In particular, in case where the sheet is used for wiping the private parts of human bodies or for cleaning easily scratching objects, its basis weight is more preferably from 40 to 60 $g/m^2$, in view of the strength and the soft feel of the sheet.

The fibrous sheet of the invention may be produced from the above-mentioned water-dispersible fibers and water-insoluble carboxymethyl cellulose in various methods. For example, the fibrous sheet may be water-decomposable paper produced in a paper-making process that comprises mixing the water-dispersible fibers and the water-insoluble carboxymethyl cellulose followed by sheeting the mixture into paper. It may also be a water-decomposable non-woven fabric produced by mixing the water-dispersible fibers and the water-insoluble carboxymethyl cellulose, forming the mixture into a fibrous web, and thereafter subjecting the fibrous web to water-jetting treatment. The water-insoluble carboxymethyl cellulose to be used herein for producing the fibrous sheet is of a type of complete substitution. Therefore, the fibrous sheet prepared in such a paper-making process or through such water-jetting treatment can be followed by the heating and drying step for removing water therefrom through vaporization, while causing no problem. That is, the decomposability in water of the fibrous sheet of the invention is not lowered by heat at the drying step.

While the water-dispersible fibers and the water-insoluble carboxymethyl cellulose are mixed in the above-mentioned two methods, the carboxymethyl cellulose is beaten (dissociated) to be more swellable thereby further increasing the strength of the fibrous sheet comprising it. Accordingly, by controlling the time and the power for mixing them, the fibrous sheet produced could have higher strength. However, if the swellability of the thus-beaten carboxymethyl cellulose increases too much, the decomposability in water of the fibrous sheet produced will be low.

The details of the water-jetting treatment are described. The fibrous web is put on a continuously moving, meshed conveyor belt, and exposed to high-pressure water-jetting streams to such a degree that the streams applied thereto could pass through its back surface. Through the water-jetting treatment, the properties of the resulting non-woven fabric are changed, depending on the basis weight of the fibrous web processed, the pore diameter of the jetting nozzles used, the number of the pores of the jetting nozzles, the passing speed at which the fibrous web is processed (processing speed), etc. Preferably, the work done to be derived from the following formula:

$$\text{Work done } (kW/m^2)=\{1.63\times\text{jetting pressure } (kg/cm)\times\text{jetting flow rate } (m^3/min)\}/\text{processing speed } (m/min),$$

falls between 0.05 and 0.5 ($kW/m^2$) in one water-jetting treatment for one surface of the fibrous web. If the work done is larger than the uppermost limit of the defined range, the fibers will be entangled too much and the decomposability in water of the resulting fibrous sheet will be lowered, or the fibrous web will be broken. If, on the other hand, the work done is smaller than the lowermost limit of the defined range, the resulting fibrous sheet could not be strong to a desired degree. One or both surfaces of the fibrous web may undergo the water-jetting treatment. For attaining the work done within the defined range, preferred are water jets from nozzles having a pore diameter of from 90 to 100 microns and disposed in CD at predetermined intervals of from 0.2 to 1.0 mm.

The fibrous sheet of the invention that comprises such a water-decomposable non-woven fabric having been subjected to water-jetting treatment is bulky and soft, and is therefore favorable to wiper applications. For example, the thickness of the fibrous sheet having been subjected to water-jetting treatment is preferably at least 0.1 mm.

The fibrous sheet of the invention is, both in dry and in wet, suitable to wiper applications. For wiper applications, however, it is desirable that the fibrous sheet has a dry strength at break of at least 1000 g/25 mm, and a wet strength at break of at least 100 g/25 mm. More preferably, the dry strength at break of the fibrous sheet is at least 1400 g/25 mm, and the wet strength at break thereof is at least 150 g/25 mm. Also preferably, the decomposability in water of the fibrous sheet, measured in wet according to JIS P4501, is at most 100 seconds, in order that the sheet ensures the strength as above and can be readily decomposed in water when disposed of (or flushed) in toilets, etc.

The fibrous sheet of the invention may contain any other compounds not interfering with the effect of the invention. For example, it may contain any of surfactants, bactericides, preservatives, deodorants, moisturizers, alcohols, etc. It may also contain an organic solvent for enhancing the wiping capability of the sheet. In this case, however, the organic solvent in the sheet must not have any negative influences on the skin and plastic objects. For this, for example, it is desirable that the organic solvent content of the solution to be impregnated into the sheet is at most 10%, more preferably at most 5%. The organic solvent includes monoalcohols such as ethanol, isopropyl alcohol, propylene glycol monomethyl ether, etc.; polyalcohols such as propylene glycol, polyethylene glycol, etc.

In order to have increased strength, the fibrous sheet of the invention may contain any other binder in addition to the water-insoluble carboxymethyl cellulose. The additional binder includes polyvinyl alcohol; modified polyvinyl alcohols such as carboxylic acid-modified polyvinyl alcohols, sulfonic acid-modified polyvinyl alcohols, etc.; alkyl celluloses such as methyl cellulose, etc.; starch, modified starches, sodium polyacrylate, sodium alginate, polyethylene oxide, etc.

The water-decomposable fibrous sheet of the invention is usable for wet tissue for wiping the skin of human bodies including the private parts thereof, and for cleaning toilets and thereabouts.

If desired, water and optionally any other compounds such as those mentioned above may be infiltrated into the water-decomposable fibrous sheet of the invention, before the sheet is packaged. In case where the sheet is wetted and packaged for public sale, it shall be airtightly packaged and put on the market so that it is not spontaneously dried. On the other hand, the sheet may be marketed in dry. The users who have bought the dry sheet may wet it with water and optionally any other compounds such as those mentioned above, before use.

EXAMPLES

The invention is described in more detail with reference to the following Examples, which, however, are not intended to restrict the scope of the invention.

Example A

Raw fibers of bleached soft-wood kraft pulp (NBKP, having a freeness of 550 ml in Canadian Standard Freeness Test (CSF)) and rayon (fiber length 6 mm, 1.5 deniers) were mixed with water-insoluble carboxymethyl cellulose (CMC) of a type of complete substitution (Nichirin Chemical's Carboxymethyl Cellulose Kiccolate, having DE of 0.42 and pH of 6.2—in this, the hydrogen atom of the carboxyl groups is 100% substituted with Ca or Na) in water, for which the blend ratio is as in Table 1. The resulting mixture was made into paper according to a paper-making process. This is Example 1. On the other hand, the mixture was made into a fibrous web according to a paper-making process, and the resulting fibrous web was subjected to water-jetting treatment. This is Example 2.

The dry strength of each fibrous sheet thus prepared herein was measured. Next, ion-exchanged water was applied to the fibrous sheets. The amount of the ion-exchanged water applied thereto was 250% by weight of the self-weight of the individual sheets. After left wetted for 24 hours, their decomposability in water and their wet strength were measured. The details are as follows:

Decomposability in Water

The test for the decomposability in water of each sample was based on the test of JIS P4501 indicating the degree of degradability of toilet paper. Precisely, the sample to be tested was cut into pieces each having a length of 10 cm and a width of 10 cm, and one piece was put into a beaker filled with 300 ml of ion-exchanged water, and stirred therein with a rotor. The revolution speed of the rotor was 600 rpm. The condition of the test piece being dispersed in water was observed, and the time until the test piece was finely dispersed was measured (see the following Table—the data are expressed in seconds).

Dry or Wet Strength

The dry or wet strength of each sample was measured as follows. The sample to be tested was cut into pieces each having a width of 25 mm and a length of 150 mm, and the pieces were tested both in the machine direction (MD) and in the cross direction (CD), by the use of a Tensilon tester, for which the chuck distance was 100 mm and the stress rate was 100 mm/min. From the data obtained, the strength of the sample was calculated according to the following formula:

$$\text{Strength}=\sqrt{[(\text{strength at break in MD})\times(\text{strength at break in CD})]}$$

The value thus obtained indicates the strength of the sample tested (see the following Table—the data are expressed in g/25 mm).

Fibrous sheets not containing water-insoluble carboxymethyl cellulose of Comparative Examples were prepared in the same manner as in Examples, and their decomposability in water and dry and wet strengths were measured also in the same manner as herein. The test results obtained are given in Table 1.

TABLE 1

| | Com. Ex. 1 | Com. Ex. 2 | Example 1 | Example 2 |
|---|---|---|---|---|
| NBKP (%) | 70 | 70 | 70 | 70 |
| Rayon (%) | 30 | 30 | 25 | 25 |
| Water-insoluble CMC (%) | — | — | 5 | 5 |
| W. J. Treatment | no | yes | no | yes |
| Basis Weight (g/m$^2$) | 50.0 | 50.0 | 50.0 | 50.0 |
| Thickness (mm) | 0.13 | 0.49 | 0.13 | 0.52 |
| Density (g/cm$^3$) | 0.38 | 0.10 | 0.38 | 0.10 |
| Dry Strength (g/25 mm) | 1931 | 1213 | 2561 | 1608 |

TABLE 1-continued

| | Com. Ex. 1 | Com. Ex. 2 | Example 1 | Example 2 |
|---|---|---|---|---|
| Wet Strength (g/25 mm) | 61 | 163 | 188 | 287 |
| Decomposability in Water (sec) | 16 | 44 | 13 | 58 |

Example B

In the same manner as in Example A, bleached soft-wood kraft pulp (NBKP) and rayon (fiber length 6 mm, 1.7 dt) were mixed with carboxymethyl cellulose of a type of complete substitution in the blend ratio indicated in Table 2, made into a fibrous web according to a paper-making process, and subjected to water-jetting treatment.

Regarding the condition for the water-jetting treatment, the nozzle diameter was 95 $\mu$m, the nozzle pitch was 0.7 mm, and the work done was 0.17514 KW/m$^2$. The fibrous sheets thus produced herein were tested for the decomposability in water, the dry strength and the wet strength also in the same manner as in Example A. The test results are given in Table 2.

Fibrous sheets of Comparative Examples were prepared in the same manner as in Examples, for which, however, no binder was used, or water-insoluble carboxymethyl cellulose of a type of 25% substitution (in which the hydrogen atom of the carboxyl groups is 25% substituted with a metal), or water-soluble carboxymethyl cellulose, or polyvinyl alcohol was used in place of the water-insoluble carboxymethyl cellulose of a type of complete substitution. The comparative sheets were also tested for the decomposability in water, the dry strength and the wet strength.

TABLE 2

| | Com. Ex. 3 | Com. Ex. 4 | Com. Ex. 5 | Com. Ex. 6 | Com. Ex. 7 | Ex. 3 | Ex. 4 |
|---|---|---|---|---|---|---|---|
| NBKP (%) | 70 | 70 | 70 | 70 | 70 | 70 | 70 |
| Rayon (%) | 30 | 25 | 25 | 25 | 25 | 25 | 20 |
| Water-insoluble CMC (%) | — | — | — | — | — | 5 | 10 |
| CMC (%) (*1) | — | 5 | — | — | — | — | — |
| CMC (%) (*2) | — | — | 5 | — | — | — | — |
| PVA (%) (*3) | — | — | — | 5 | — | — | — |
| PVA (%) (*4) | — | — | — | — | 5 | — | — |
| Basis Weight (g/m$^2$) | 50.0 | 50.0 | 50.0 | 50.0 | 50.0 | 50.0 | 50.0 |
| Thickness (mm) | 0.49 | 0.52 | 0.51 | 0.52 | 0.52 | 0.52 | 0.52 |
| Density (g/cm$^3$) | 0.10 | 0.10 | 0.10 | 0.10 | 0.10 | 0.10 | 0.10 |
| Dry Strength (g/25 mm) | 1213 | 1451 | 1550 | 1746 | 1690 | 1608 | 1428 |
| Wet Strength (g/25 mm) | 163 | 205 | 227 | 219 | 238 | 287 | 171 |
| Decomposability in Water (sec) | 44 | 83 | 78 | >300 | >300 | 58 | 66 |

*1: Nichirin Chemical's product with DE of 0.43 and pH of 5.8.
*2: Nichirin Chemical's product with DE of 0.45 and pH of 6.6.
*3: Kuraray's Vinylon of grade VPD.
*4: Kuraray's Vinylon of grade VPB.

Example C

In the same manner as in Example A, bleached soft-wood kraft pulp (NBKP) and rayon (fiber length 6 mm, 1.7 dt) were mixed with water-insoluble carboxymethyl cellulose of a type of complete substitution in the blend ratio as in Table 3, made into a fibrous web according to a paper-making process, and subjected to water-jetting treatment. In this, used were different types of water-insoluble carboxymethyl cellulose that differ from each other in the type of metal substitution in the carboxyl groups. For preparing the fibrous web, the starting materials as above were mixed at a concentration of 0.625% in a home juicer-mixer for a predetermined period of time as in Table 3, within which the water-insoluble carboxymethyl cellulose was beaten and dissociated. The condition for the water-jetting treatment employed herein was the same as that in Example B.

A fibrous sheet not containing water-insoluble carboxymethyl cellulose of Comparative Example was prepared in the same manner as in Examples, and its decomposability in water and dry and wet strengths were measured also in the same manner as herein. The test results obtained are given in Table 3.

TABLE 3

| | Com. Ex. 8 | Ex. 5 | Ex. 6 | Ex. 7 | Ex. 8 | Ex. 9 | Ex. 10 |
|---|---|---|---|---|---|---|---|
| NBKP (%) | 70 | 70 | 70 | 70 | 70 | 70 | 70 |
| Rayon (%) | 30 | 25 | 25 | 25 | 25 | 25 | 25 |
| CMC Na/Ca = 4/0 (%) | — | 5 | — | — | — | — | 5 |
| CMC Na/Ca = 3/1 (%) | — | — | 5 | — | — | — | — |
| CMC Na/Ca = 2/2 (%) | — | — | — | 5 | — | — | — |
| CMC Na/Ca = 1/3 (%) | — | — | — | — | 5 | — | — |
| CMC Na/Ca = 0/4 (%) | — | — | — | — | — | 5 | — |
| Stock Beating Time (sec) | 15 | 15 | 15 | 15 | 15 | 15 | 60 |
| Basis Weight ($g/m^2$) | 50.0 | 50.0 | 50.0 | 50.0 | 50.0 | 50.0 | 50.0 |
| Thickness (mm) | 0.49 | 0.47 | 0.47 | 0.45 | 0.46 | 0.46 | 0.44 |
| Density ($g/cm^3$) | 0.10 | 0.11 | 0.11 | 0.11 | 0.11 | 0.11 | 0.11 |
| Dry Strength (g/25 mm) | 1213 | 1995 | 2207 | 1758 | 1688 | 1437 | 2202 |
| Wet Strength (g/25 mm) | 163 | 289 | 341 | 291 | 302 | 30 | 358 |
| Decomposability in Water (sec) | 44 | 67 | 66 | 50 | 57 | 67 | 99 |

As will be understood from the data as above, the fibrous sheet of the invention well decomposes in water and has good dry strength and good wet strength, even though not containing an organic solvent such as that in conventional fibrous sheets.

Here, 'comprises/comprising' when used in this specification is taken to specify the presence of stated features, integers, steps or components but does not preclude the presence or addition of one or more other features, integers, steps, components or groups thereof.

While the invention has been described in detail and with reference to specific embodiments thereof, it will be apparent to one skilled in the art that various changes and modifications can be made therein without departing from the spirit and scope thereof.

What is claimed is:

1. A water-decomposable fibrous sheet comprising water-dispersible fibers and water-insoluble carboxymethyl cellulose, wherein;

the water-insoluble carboxymethyl cellulose has a degree of substitution for etherification (DE) falling between 0.3 and 0.6, and, in the water-insoluble carboxymethyl cellulose, the hydrogen of the carboxyl group in at least 95% of the carboxymethyl groups is substituted with a metal;

and wherein the water-decomposable fibrous sheet has a degree of decomposition in water of at most 100 seconds measured when wet, a strength at breakage when dry of at least 1000 g/25 mm, and a strength at breakage when wet of at least 100 g/25 mm.

2. The water-decomposable fibrous sheet as set forth in claim 1, wherein the metal is at least one selected from the group consisting of calcium, sodium, magnesium, zinc, manganese, lithium, barium and aluminium.

3. The water-decomposable fibrous sheet as set forth in claim 1, which has a basis weight falling between 30 and 80 $g/m^2$.

4. The water-decomposable fibrous sheet as set forth in claim 3, of which the water-insoluble carboxymethyl cellulose content falls between 0.5 and 10% by weight.

5. The water-decomposable fibrous sheet as set forth in claim 3, which has a thickness of at least 0.1 mm.

6. The water-decomposable fibrous sheet as set forth in claim 1, which is a water-decomposable non-woven fabric having been subjected to water-jetting treatment.

7. The water-decomposable fibrous sheet as set forth in claim 1, which is water-decomposable paper having been prepared in a paper-making process.

8. The water-decomposable fibrous sheet as set forth in claim 1, wherein the water-dispersible fibers are fibers of at least one type selected from group consisting of pulp, regenerated cellulose, Manila hemp, and linter pulp.

* * * * *